US012188165B2

(12) United States Patent
Chung

(10) Patent No.: US 12,188,165 B2
(45) Date of Patent: Jan. 7, 2025

(54) WASHING MACHINE APPLIANCE INTERFACES

(71) Applicant: Haier US Appliance Solutions, Inc., Wilmington, DE (US)

(72) Inventor: Myunggeon Chung, Seoul (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 204 days.

(21) Appl. No.: 17/958,693

(22) Filed: Oct. 3, 2022

(65) Prior Publication Data

US 2024/0110323 A1 Apr. 4, 2024

(51) Int. Cl.

| | |
|---|---|
| ***D06F 33/47*** | (2020.01) |
| ***D06F 34/18*** | (2020.01) |
| *D06F 34/05* | (2020.01) |
| *D06F 103/04* | (2020.01) |
| *D06F 105/58* | (2020.01) |

(52) U.S. Cl.

CPC ..... *D06F 33/47* (2020.02); *D06F 34/18* (2020.02); *D06F 34/05* (2020.02); *D06F 2103/04* (2020.02); *D06F 2105/58* (2020.02)

(58) Field of Classification Search

CPC ..... D06F 33/47; D06F 34/18; D06F 2105/58; D06F 34/05; D06F 2103/04

See application file for complete search history.

(56) References Cited

U.S. PATENT DOCUMENTS

| | | | | |
|---|---|---|---|---|
| 10,030,883 | B2 | 7/2018 | Liu et al. | |
| 10,215,491 | B2 * | 2/2019 | Ashrafzadeh | D06F 33/00 |
| 11,098,430 | B2 | 8/2021 | Belveal et al. | |
| 11,245,544 | B2 | 2/2022 | Lee | |
| 11,866,869 | B1 * | 1/2024 | Yoon | D06F 34/18 |
| 2016/0160432 | A1 * | 6/2016 | Ashrafzadeh | D06F 58/30 68/12.02 |
| 2021/0381152 | A1 | 12/2021 | Belveal et al. | |
| 2022/0178064 | A1 * | 6/2022 | Dillon | D06F 33/32 |
| 2022/0243378 | A1 * | 8/2022 | Yoon | D06F 33/32 |
| 2023/0140235 | A1 * | 5/2023 | Masters, Jr. | D06F 58/02 34/318 |
| 2024/0011212 | A1 * | 1/2024 | Kwak | D06F 34/20 |
| 2024/0011213 | A1 * | 1/2024 | Yoon | G06V 10/82 |

FOREIGN PATENT DOCUMENTS

| | | |
|---|---|---|
| CN | 101964098 A | 2/2011 |
| CN | 108053574 A | 5/2018 |
| CN | 105763652 B | 5/2019 |
| CN | 110241553 A | 9/2019 |

(Continued)

OTHER PUBLICATIONS

Machine Translation of TW-512037-U to Lee et al., Nov. 2015. (Year: 2015).*

*Primary Examiner* — Benjamin L Osterhout

(74) *Attorney, Agent, or Firm* — Dority & Manning, P.A.

(57) ABSTRACT

A method of operating a washing machine appliance includes obtaining, by a remote user interface device, an image of a wash basket of the washing machine appliance and a load of articles therein. The method also includes determining, based on the image, a load size of the load of articles in the wash basket. The method further includes comparing the determined load size to a maximum load size threshold.

18 Claims, 7 Drawing Sheets

(56) References Cited

FOREIGN PATENT DOCUMENTS

| | | | | |
|---|---|---|---|---|
| CN | 111607938 | A | | 9/2020 |
| CN | 107543286 | B | | 11/2020 |
| CN | 111998448 | A | | 11/2020 |
| CN | 112281403 | A | | 1/2021 |
| CN | 112781178 | A | | 5/2021 |
| TW | 512037 | U | * | 11/2015 |
| TW | M512037 | U | | 11/2015 |
| WO | WO2020125663 | A1 | | 6/2020 |

* cited by examiner

WASHING MACHINE APPLIANCE INTERFACES

FIELD OF THE INVENTION

The present subject matter relates generally to washing machine appliances, and more particularly to an improved interface for washing machine appliances.

BACKGROUND OF THE INVENTION

Washing machine appliances generally include a wash tub for containing water or wash fluid (e.g., water, detergent, bleach, or other wash additives). A basket is rotatably mounted within the wash tub and defines a wash chamber for receipt of articles for washing. During normal operation of such washing machine appliances, the wash fluid is directed into the wash tub and onto articles within the wash chamber of the basket. The basket or an agitation element can rotate at various speeds to agitate articles within the wash chamber, to wring wash fluid from articles within the wash chamber, etc.

Washing machine appliances perform optimally when a size of a load of articles in the basket is less than or equal to a maximum size, such as a recommended load size. For example, the recommended load size is typically less than the entire volume of the wash basket, e.g., in order to promote tumbling and/or agitation of articles within the wash basket or to promote wash fluid flowing freely between the articles such that the wash fluid fully contacts and/or saturates each article in the load of articles.

Conventional user interfaces for washing machine appliances receive inputs from a user regarding characteristics of the load of articles to be washed, e.g., load size. Such interfaces, however, rely on the user to provide accurate information regarding the load of articles, such as the size of the load. Moreover, such interfaces are not intuitive, e.g., a user may be required to subjectively determine what constitutes a "large" load size or a "medium" load size, where such load sizes may be abstract concepts to the user. When the user provides inaccurate information, such as an incorrect load size or when the user overloads the washing machine appliance, the performance of the washing machine appliance may be impaired and/or the results of washing operations may be less than optimal.

As a result, it is desired in the art to provide improved interfaces for washing machine appliances, such as a user interface which is interactive and updatable, such as a user interface configured to provide information regarding a load of articles in the washing machine appliance, such as information regarding recommended load size.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a washing machine appliance is provided. The method includes obtaining, by a remote user interface device, an image of a wash basket of the washing machine appliance and a load of articles therein. The method also includes determining, based on the image, a load size of the load of articles in the wash basket. The method further includes comparing the determined load size to a maximum load size threshold. The method also includes providing a user notification on the remote user interface device in response to the determined load size being greater than the maximum load size threshold.

In another exemplary aspect of the present disclosure, a method of operating a washing machine appliance is provided. The method includes obtaining, by a remote user interface device, an image of a wash basket of the washing machine appliance and a load of articles therein. The method also includes determining, based on the image, a load size of the load of articles in the wash basket. The method further includes comparing the determined load size to a maximum load size threshold. The method also includes unlocking the washing machine appliance in response to the determined load size being less than the maximum load size threshold and activating the washing machine appliance after unlocking the washing machine appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
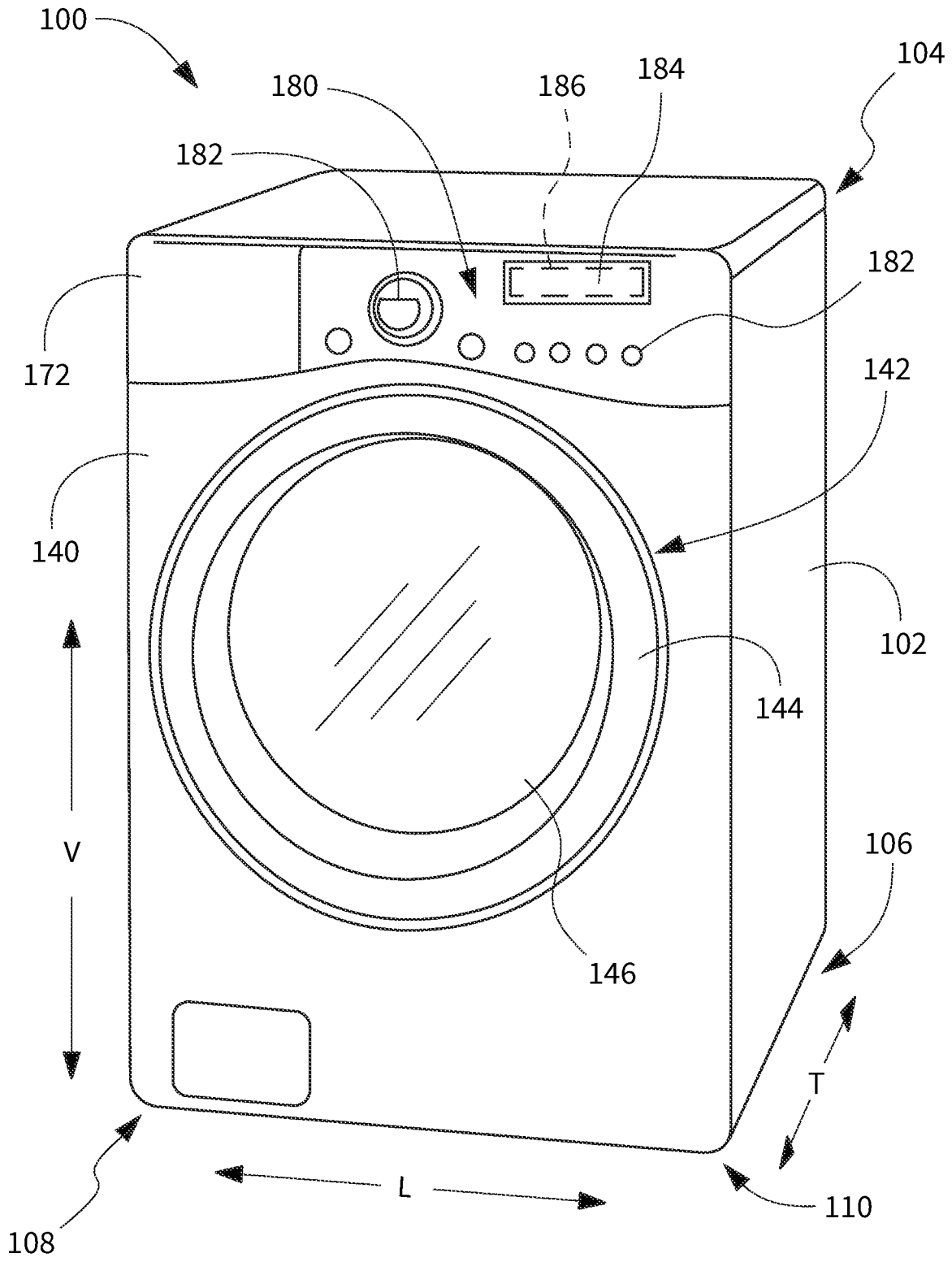
FIG. 1 provides a front perspective view of an exemplary washing machine appliance in accordance with one or more exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one element from another and are not intended to signify location or importance of the individual elements. Terms such as "inner" and "outer" refer to relative directions with respect to the interior and exterior of the washing machine appliance, and in particular the wash basket therein. For example, "inner" or "inward" refers to the direction towards the interior of the washing machine appliance. Terms such as "left," "right," "front," "back," "top," or "bottom" are used with reference to the perspective of a user accessing the washing machine appliance. For example, a user stands in front of the washing machine appliance to open the door and reaches into the wash basket to access items therein. Furthermore, it should be appreciated that as used herein, terms of approximation, such as "approximately," "generally," "substantially," or "about," refer to being within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

Figure 2:
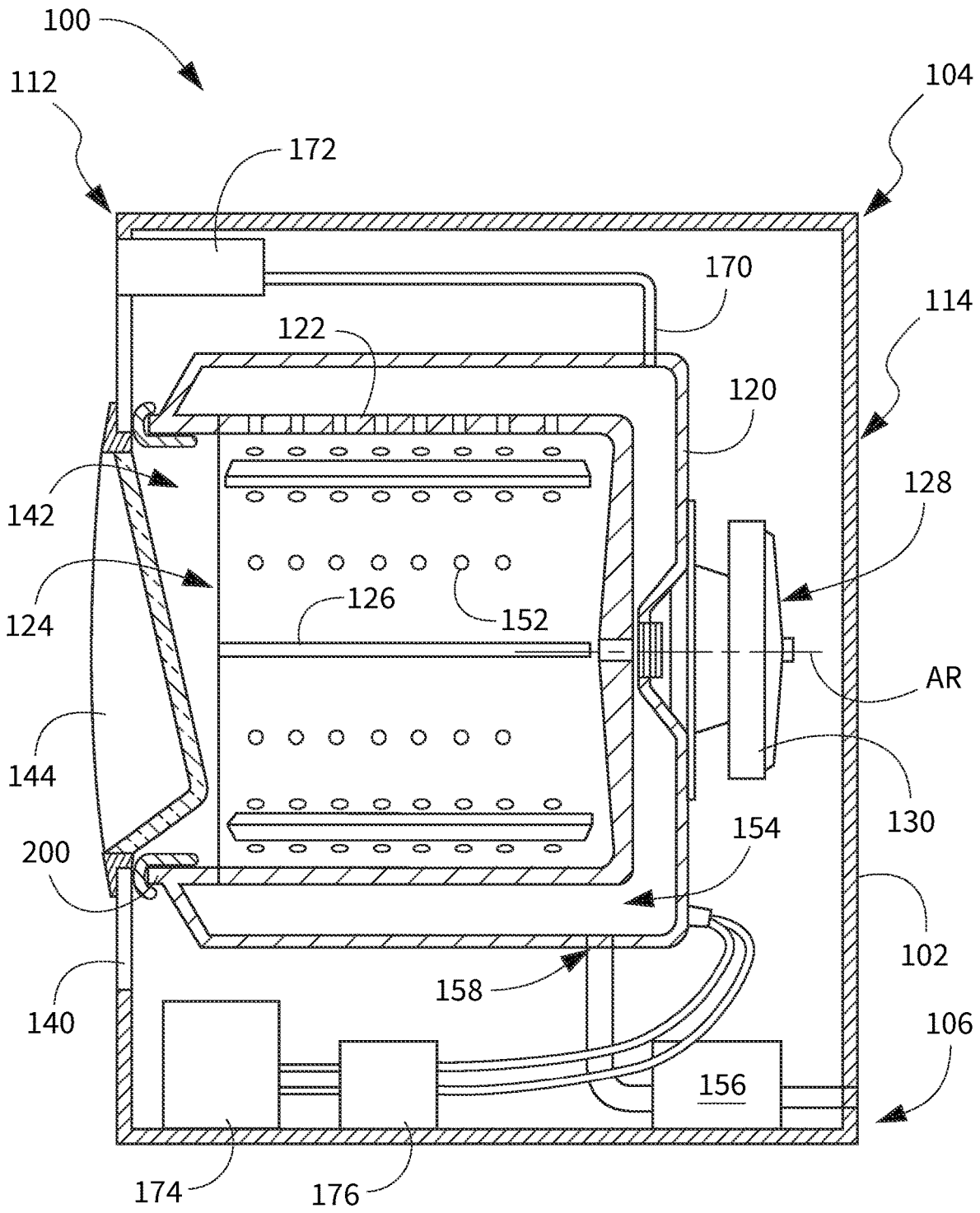
FIG. 2 provides a transverse cross-sectional view of the exemplary washing machine appliance of FIG. 1.

Referring now to the figures, FIG. 1 is a perspective view of an exemplary horizontal axis washing machine appliance 100 and FIG. 2 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T.

Referring to FIG. 2, a wash tub 120 is positioned within cabinet 102 and is generally configured for retaining wash fluids during an operating cycle. As used herein, "wash fluid" may refer to water, detergent, fabric softener, bleach, or any other suitable wash additive or combination thereof. A wash basket 122 is received within wash tub 120 and defines a wash chamber 124 that is configured for receipt of articles for washing. More specifically, wash basket 122 is rotatably mounted within wash tub 120 such that it is rotatable about an axis of rotation AR. According to the illustrated embodiment, the axis of rotation is substantially parallel to the transverse direction T. In this regard, washing machine appliance 100 is generally referred to as a "horizontal axis" or "front load" washing machine appliance 100. However, it should be appreciated that aspects of the present subject matter may be used within the context of a vertical axis or top load washing machine appliance as well.

Wash basket 122 may define one or more agitator features that extend into wash chamber 124 to assist in agitation and cleaning articles disposed within wash chamber 124 during operation of washing machine appliance 100. For example, as illustrated in FIG. 2, a plurality of ribs 126 extends from basket 122 into wash chamber 124. In this manner, for example, ribs 126 may lift articles disposed in wash basket 122 during rotation of wash basket 122.

Washing machine appliance 100 includes a drive assembly 128 which is coupled to wash tub 120 and is generally configured for rotating wash basket 122 during operation, e.g., such as during an agitation or spin cycle. More specifically, as best illustrated in FIG. 2, drive assembly 128 may include a motor assembly 130 that is in mechanical communication with wash basket 122 to selectively rotate wash basket 122 (e.g., during an agitation or a rinse cycle of washing machine appliance 100). According to the illustrated embodiment, motor assembly 130 is a pancake motor. However, it should be appreciated that any suitable type, size, or configuration of motors may be used to rotate wash basket 122 according to alternative embodiments. In addition, drive assembly 128 may include any other suitable number, types, and configurations of support bearings or drive mechanisms.

Referring generally to FIGS. 1 and 2, cabinet 102 also includes a front panel 140 that defines an opening 142 that permits user access to wash basket 122. More specifically, washing machine appliance 100 includes a door 144 that is positioned over opening 142 and is rotatably, e.g., pivotably, mounted to front panel 140 (e.g., about a door axis that is substantially parallel to the vertical direction V). In this manner, door 144 permits selective access to opening 142 by being movable between an open position (not shown) facilitating access to a wash tub 120 and a closed position (FIG. 1) prohibiting access to wash tub 120. For example, when the door 144 is in the closed position, the wash tub 120 may be enclosed by the door 144 and the cabinet 102. A gasket 200 may be provided in the opening 142 and the gasket 200 may sealingly engage the door 144 when the door 144 is in the closed position. For example, the gasket 200 may extend between the tub 120 and the front panel 140, e.g., generally along the transverse direction T and may extend about or around the opening 142 such that the gasket 200 is covered by the door 144 when the door 144 is in the closed position, and the gasket 200 may promote sealing between the door 144 and the cabinet 102, e.g., the front panel 140 of the cabinet 102.

In some embodiments, a window 146 in door 144 permits viewing of wash basket 122 when door 144 is in the closed position (e.g., during operation of washing machine appliance 100). Door 144 also includes a handle (not shown) that, for example, a user may pull when opening and closing door 144. Further, although door 144 is illustrated as mounted to front panel 140, it should be appreciated that door 144 may be mounted to another side of cabinet 102 or any other suitable support according to alternative embodiments.

Referring again to FIG. 2, wash basket 122 also defines a plurality of perforations 152 in order to facilitate fluid communication between an interior of basket 122 and wash tub 120. A sump 154 is defined by wash tub 120 at a bottom of wash tub 120 along the vertical direction V. Thus, sump 154 is configured for receipt of, and generally collects, wash fluid during operation of washing machine appliance 100. For example, during operation of washing machine appliance 100, wash fluid may be urged (e.g., by gravity) from basket 122 to sump 154 through the plurality of perforations 152. A pump assembly 156 is located beneath wash tub 120 for gravity assisted flow when draining wash tub 120 (e.g., via a drain 158). Pump assembly 156 is also configured for recirculating wash fluid within wash tub 120. Accordingly, pump assembly 156 may also be referred to or include a drain pump and/or a circulation pump.

Referring still to FIGS. 1 and 2, in some embodiments, washing machine appliance 100 may include an additive dispenser or spout 170. For example, spout 170 may be in fluid communication with a water supply (not shown) in order to direct fluid (e.g., clean water) into wash tub 120. Spout 170 may also be in fluid communication with the sump 154. For example, pump assembly 156 may direct wash fluid disposed in sump 154 to spout 170 in order to circulate wash fluid in wash tub 120.

As illustrated, a detergent drawer 172 may be slidably mounted within front panel 140. Detergent drawer 172 receives a wash additive (e.g., detergent, fabric softener, bleach, or any other suitable liquid or powder) and directs the fluid additive to wash chamber 124 during operation of washing machine appliance 100. According to the illustrated embodiment, detergent drawer 172 may also be fluidly coupled to spout 170 to facilitate the complete and accurate dispensing of wash additive.

In some embodiments, an optional bulk reservoir 174 may be disposed within cabinet 102. Bulk reservoir 174 may be configured for receipt of fluid additive for use during operation of washing machine appliance 100. Moreover, bulk reservoir 174 may be sized such that a volume of fluid additive sufficient for a plurality or multitude of wash cycles of washing machine appliance 100 (e.g., five, ten, twenty, fifty, or any other suitable number of wash cycles) may fill bulk reservoir 174. Thus, for example, a user can fill bulk reservoir 174 with fluid additive and operate washing machine appliance 100 for a plurality of wash cycles without refilling bulk reservoir 174 with fluid additive. A reservoir pump 176 may be configured for selective delivery of the fluid additive from bulk reservoir 174 to wash tub 120.

A control panel 180 including a plurality of input selectors 182 may be coupled to front panel 140. Control panel 180 and input selectors 182 collectively form a user interface input for operator selection of machine cycles and features. A display 184 of control panel 180 indicates selected features, operation mode, a countdown timer, and/or other items of interest to appliance users regarding operation.

Operation of washing machine appliance 100 is controlled by a processing device or a controller 186 that is operatively coupled to control panel 180 for user manipulation to select washing machine cycles and features. In response to user manipulation of control panel 180, controller 186 operates the various components of washing machine appliance 100 to execute selected machine cycles and features. Controller 186 may include a memory and microprocessor, such as a general or special purpose microprocessor operable to execute programming instructions or micro-control code associated with methods described herein. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 186 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 180 may be in communication with controller 186 via one or more signal lines or shared communication busses to provide signals to and/or receive signals from the controller 186.

In addition, the memory or memory devices of the controller 186 can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 186 may be operable to execute programming instructions or micro-control code associated with an operating cycle of washing machine appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 186 as disclosed herein is capable of and may be operable to perform any methods, method steps, or portions of methods as disclosed herein. For example, in some embodiments, methods disclosed herein may be embodied in programming instructions stored in the memory and executed by controller 186.

The memory devices may also store data that can be retrieved, manipulated, created, or stored by the one or more processors or portions of controller 186. The data can include, for instance, data to facilitate performance of methods described herein. The data can be stored locally (e.g., on controller 186) in one or more databases and/or may be split up so that the data is stored in multiple locations. In addition, or alternatively, the one or more database(s) can be connected to controller 186 through any suitable network(s), such as through a high bandwidth local area network (LAN) or wide area network (WAN). In this regard, for example, controller 186 may further include a communication module or interface that may be used to communicate with one or more other component(s) of washing machine appliance 100, controller 186, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

In exemplary embodiments, during operation of washing machine appliance 100, laundry items are loaded into wash basket 122 through opening 142, and a wash operation is initiated through operator manipulation of input selectors 182. For example, a wash cycle may be initiated such that wash tub 120 is filled with water, detergent, or other fluid additives (e.g., via detergent drawer 172 or bulk reservoir 174). One or more valves (not shown) can be controlled by washing machine appliance 100 to provide for filling wash basket 122 to the appropriate level for the amount of articles being washed or rinsed. By way of example, once wash basket 122 is properly filled with fluid, the contents of wash basket 122 can be agitated (e.g., with ribs 126) for an agitation phase of laundry items in wash basket 122. During the agitation phase, the basket 122 may be motivated about the axis of rotation AR at a set speed (e.g., first speed or tumble speed). As the basket 122 is rotated, articles within the basket 122 may be lifted and permitted to drop therein.

After the agitation phase of the washing operation is completed, wash tub 120 can be drained, e.g., by drain pump assembly 156. Laundry articles can then be rinsed (e.g., through a rinse cycle) by again adding fluid to wash tub 120, depending on the particulars of the cleaning cycle selected by a user. Ribs 126 may again provide agitation within wash basket 122. One or more spin cycles may also be used. In particular, a spin cycle may be applied after the wash cycle or after the rinse cycle in order to wring wash fluid from the articles being washed. During a spin cycle, basket 122 is rotated at relatively high speeds. For instance, basket 122 may be rotated at one set speed (e.g., second speed or pre-plaster speed) before being rotated at another set speed (e.g., third speed or plaster speed). As would be understood, the pre-plaster speed may be greater than the tumble speed and the plaster speed may be greater than the pre-plaster speed. Moreover, agitation or tumbling of articles may be reduced as basket 122 increases its rotational velocity such that the plaster speed maintains the articles at a generally fixed position relative to basket 122. After articles disposed in wash basket 122 are cleaned (or the washing operation otherwise ends), a user can remove the articles from wash basket 122 (e.g., by opening door 144 and reaching into wash basket 122 through opening 142).

During such operations, the gasket 200 may help to contain wash fluid within the cabinet 102, particularly within the tub 120. As generally shown in FIG. 2, the gasket 200 may be positioned between the door 144 and the tub 120, e.g., when the door 144 is in the closed position as in FIG. 2. Thus, the gasket 200 may sealingly engage the door 144 when the door 144 is in the closed position. In general, the gasket 200 sealingly engages the cabinet 102, in particular the opening 142 thereof, the tub 120, and the door 144. For example, the gasket 200 may extend around the opening 142 along a perimeter, e.g., circumference, of the opening 142 and may extend between the cabinet 102 and the wash tub 120 along a longitudinal axis, such as along or generally parallel to the transverse direction T.

It should be appreciated that the present subject matter is not limited to any particular style, model, or configuration of washing machine appliance. The exemplary embodiment depicted in FIGS. 1 and 2 is simply provided for illustrative purposes only. While described in the context of a specific embodiment of horizontal axis washing machine appliance 100, it will be understood that horizontal axis washing machine appliance 100 is provided by way of example only. Other washing machine appliances having different configurations, different appearances, and/or different features may also be utilized with the present subject matter as well. For example, different locations may be provided for the user interface, different configurations may be provided, e.g., vertical axis washing machines, and other differences may be applied as well.

Figure 3:
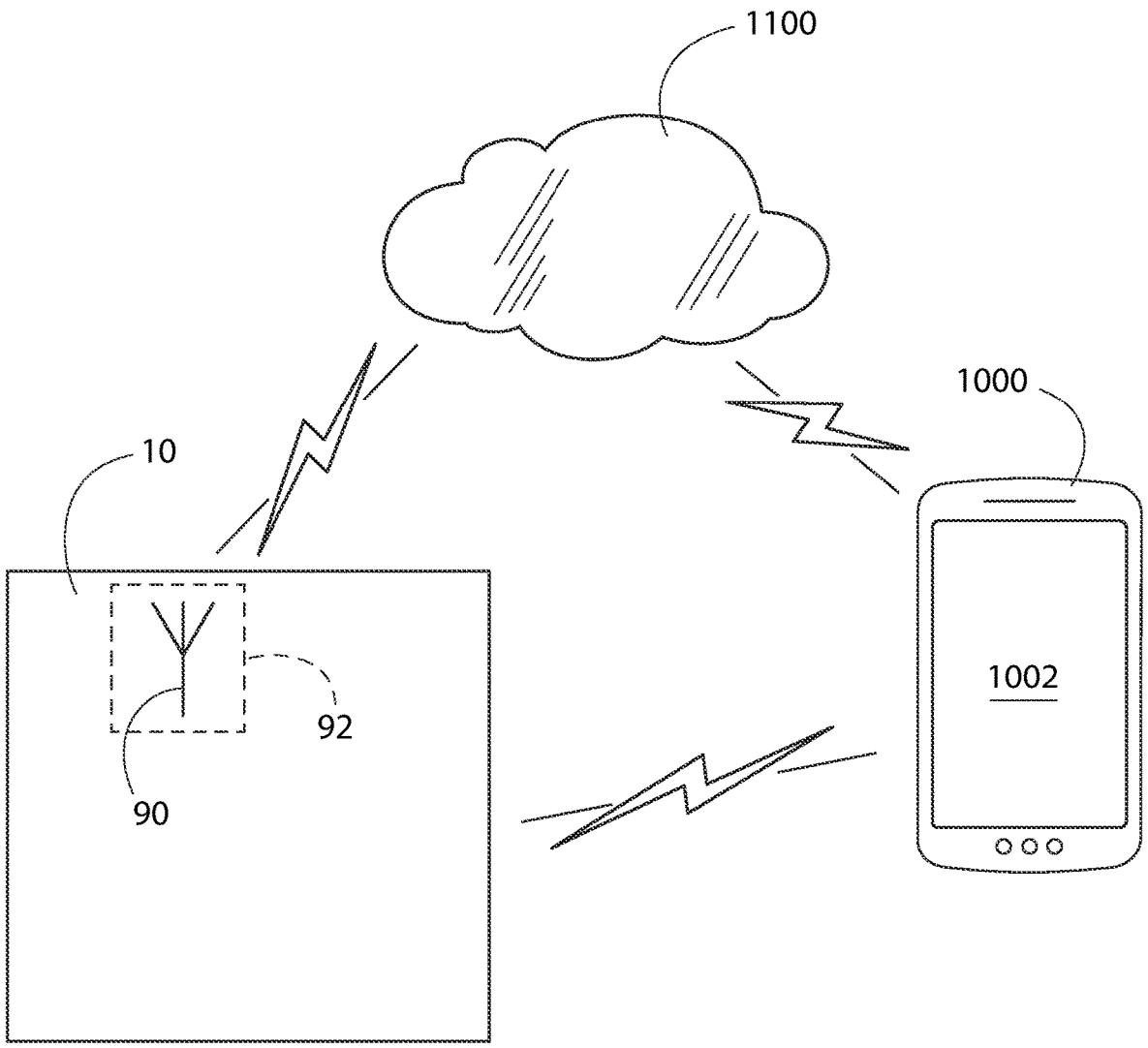
FIG. 3 provides a diagrammatic illustration of a washing machine appliance in communication with a remote computing device and with a remote user interface device according to one or more exemplary embodiments of the present subject matter.

Turning now to FIG. 3, a general schematic is provided of a washing machine appliance 10, such as but not limited to washing machine appliance 100 described above, which communicates wirelessly with a remote user interface device 1000 and a network 1100. For example, as illustrated in FIG. 3, the washing machine appliance 100 may include an antenna 90 by which the washing machine appliance 100 communicates with, e.g., sends and receives signals to and from, the remote user interface device 1000 and/or network 1100. The antenna 90 may be part of, e.g., onboard, a communications module 92. The communications module 92 may be a wireless communications module operable to connect wirelessly, e.g., over the air, to one or more other devices via any suitable wireless communication protocol. For example, the communications module 92 may be a WI-FI® module, a BLUETOOTH® module, or a combination module providing both WI-FI® and BLUETOOTH® connectivity. The remote user interface device 1000 may be a laptop computer, smartphone, tablet, personal computer, wearable device, smart speaker, smart home system, and/or various other suitable devices. The communications module 92 may be onboard the controller 186 or may be a separate module.

The washing machine appliance 10 may be in communication with the remote user interface device 1000 device through various possible communication connections and interfaces. The washing machine appliance 10 and the remote user interface device 1000 may be matched in wireless communication, e.g., connected to the same wireless network. The washing machine appliance 10 may communicate with the remote user interface device 1000 via short-range radio such as BLUETOOTH® or any other suitable wireless network having a layer protocol architecture. As used herein, "short-range" may include ranges less than about ten meters and up to about one hundred meters. For example, the wireless network may be adapted for short-wavelength ultra-high frequency (UHF) communications in a band between 2.4 GHz and 2.485 GHz (e.g., according to the IEEE 802.15.1 standard). In particular, BLUETOOTH® Low Energy, e.g., BLUETOOTH® Version 4.0 or higher, may advantageously provide short-range wireless communication between the washing machine appliance 10 and the remote user interface device 1000. For example, BLUETOOTH® Low Energy may advantageously minimize the power consumed by the exemplary methods and devices described herein due to the low power networking protocol of BLUETOOTH® Low Energy.

The remote user interface device 1000 is "remote" at least in that it is spaced apart from and not structurally connected to the washing machine appliance 10, e.g., the remote user interface device 1000 is a separate, stand-alone device from the washing machine appliance 10 which communicates with the washing machine appliance 10 wirelessly. Any suitable device separate from the washing machine appliance 10 that is configured to provide and/or receive communications, information, data, or commands from a user may serve as the remote user interface device 1000, such as a smartphone (e.g., as illustrated in FIG. 3), smart watch, personal computer, smart home system, or other similar device. For example, the remote user interface device 1000 may be a smartphone operable to store and run applications, also known as "apps," and some or all of the method steps disclosed herein may be performed by a smartphone app.

The remote user interface device 1000 may include a memory for storing and retrieving programming instructions. Thus, the remote user interface device 1000 may provide a remote user interface which may be an additional user interface to the user interface panel 180. For example, the remote user interface device 1000 may be a smartphone operable to store and run applications, also known as "apps," and the additional user interface may be provided as a smartphone app.

As mentioned above, the washing machine appliance 10 may also be configured to communicate wirelessly with a network 1100. The network 1100 may be, e.g., a cloud-based data storage system including one or more remote computing devices such as remote databases and/or remote servers, which may be collectively referred to as "the cloud." The network 1100 may include, e.g., one or more remote computing devices, such as a remote database, remote server, etc., in a distributed computing environment. Such distributed computing environments may include, for example, cloud computing, fog computing, and/or edge computing. For example, the washing machine appliance 10 may communicate with the network 1100 over the Internet, which the washing machine appliance 10 may access via WI-FI®, such as from a WI-FI® access point in a user's home, or in a laundromat or dormitory, etc.

The remote user interface device 1000 may be configured to capture and/lor display images. For example, the remote user interface device 1000 may be a smartphone, e.g., as illustrated in FIG. 3, which includes both a camera (not shown) for capturing images and a display 1002, e.g., a touchscreen or other screen, for displaying images.

Various examples of images which may be captured or obtained by the remote user interface device 1000 are illustrated in FIGS. 4 through 7. As is generally seen throughout FIGS. 4 through 7, the images generally include at least a portion of the wash chamber 124 within the frame of the image.

Figure 4:
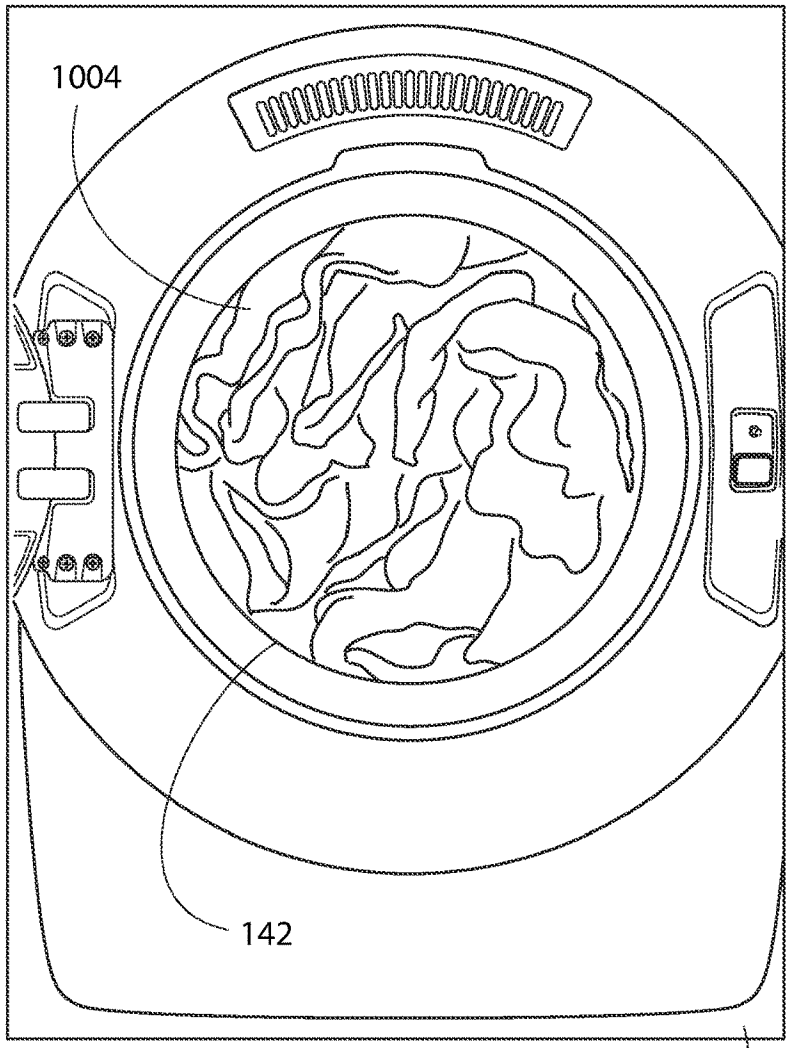
FIG. 4 illustrates an exemplary image which may be displayed on a display of a remote user interface device, where the image includes an image of a washing machine appliance, according to one or more exemplary embodiments of the present subject matter.
Figure 6:
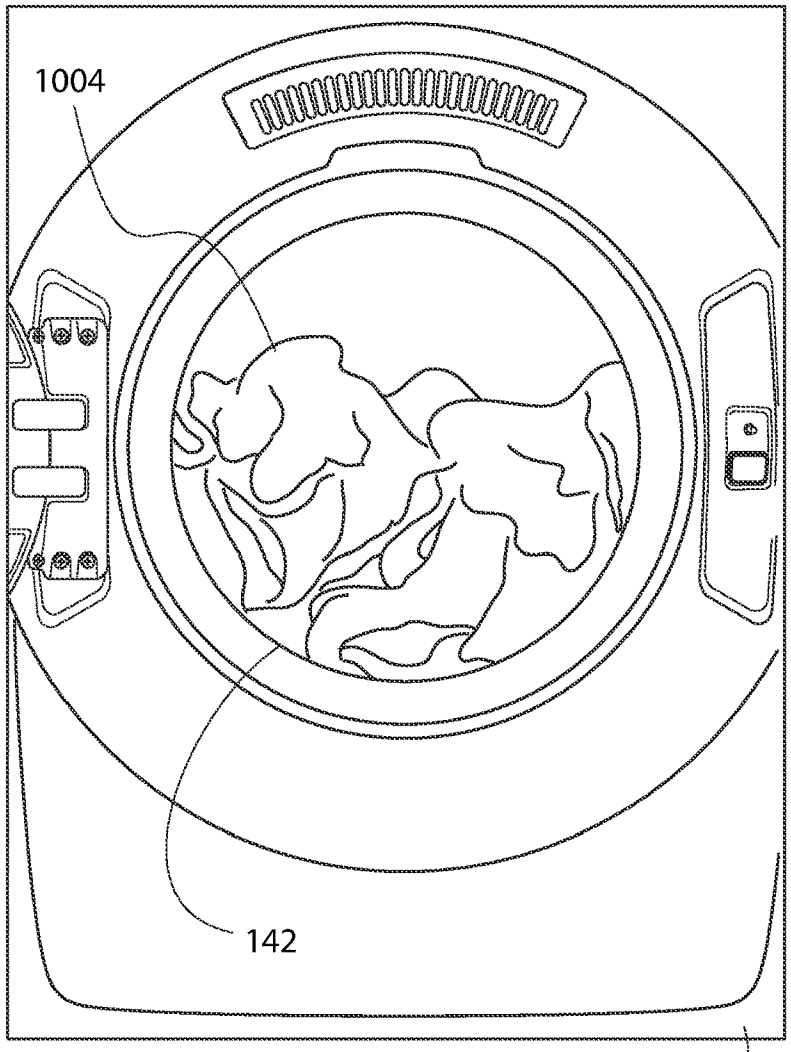
FIG. 6 illustrates an exemplary image which may be displayed on a display of a remote user interface device, where the image includes an image of a washing machine appliance, according to one or more exemplary embodiments of the present subject matter.

The image or images obtained by or with the remote user interface device, e.g., using the camera thereof, such as the example images illustrated in FIGS. 4 and 6, may be analyzed to determine the size, proportion, and/or position of various components of the washing machine appliance, such as the wash basket, the wash chamber defined in the wash basket, and/or a load of articles positioned in the wash chamber, based at least in part on the one or more images, e.g., based on an image processing algorithm and a machine learning image recognition process. Each of these image evaluation processes will be described below according to exemplary embodiments of the present subject matter. It should be appreciated that image processing and machine learning image recognition processes may be used together to provide an extra safety factor and redundant detection methods to improve the accuracy of detecting the size, proportion, and/or position of the selected components of interest. In some exemplary embodiments, such redundant or duplicative detection methods may be desirable to improve the likelihood of accurate detection.

As used herein, the term "image processing algorithm" and the like is generally intended to refer to any suitable methods or algorithms for analyzing images of wash chamber 124 and/or a load of articles therein that do not rely on artificial intelligence or machine learning techniques (e.g., in contrast to the machine learning image recognition process as described below). For example, the image processing algorithm may rely on image differentiation, e.g., such as a pixel-by-pixel comparison of two sequential images. Image differentiation may be used to, for example, determine if a position, location, or geometric property, e.g., shape, area, or dimension, etc., of a component changes, such as crosses a threshold, e.g., a minimum or maximum, such as a minimum or maximum load size of a load of articles in the wash chamber 124.

Additional embodiments may also include using a machine learning image recognition process instead of or in addition to an image processing algorithm. In this regard, the images obtained by the camera may be analyzed by controller 186. In addition, it should be appreciated that this image analysis or processing may be performed locally (e.g., by controller 186) or remotely, such as by using distributed computing, a digital cloud, or a remote server, such as in a cloud computing system or other distributed computing environment, e.g., edge computing or fog computing. According to exemplary embodiments of the present subject matter, the images obtained with the camera may be analyzed using a neural network classification module and/or a machine learning image recognition process. In this regard, for example, controller 186 may be programmed to implement the machine learning image recognition process that includes a neural network trained with a plurality of images of the wash chamber 124 and/or controller 186 may communication with a remote server (such as in the cloud, etc., as mentioned) where the remote server implements all or a portion of the machine learning image recognition process.

As used herein, the terms image recognition process and similar terms may be used generally to refer to any suitable method of observation, analysis, image decomposition, feature extraction, image classification, etc. of one or more images or videos taken of a wash chamber of a washing machine appliance, such as images or videos of areas, volumes, and/or regions within and/or around the wash chamber. In this regard, the image recognition process may use any suitable artificial intelligence (AI) technique, for example, any suitable machine learning technique, or for example, any suitable deep learning technique. It should be appreciated that any suitable image recognition software or process may be used to analyze images taken by the camera, and that controller 186 may be programmed to perform such processes and take corrective action or other responsive actions.

According to an exemplary embodiment, controller may implement a form of image recognition called region-based convolutional neural network ("R-CNN") image recognition. Generally speaking, R-CNN may include taking an input image and extracting region proposals that include a potential object, such as a particular garment, a region of a load of clothes, or the size or position of the agitation element. In this regard, a "region proposal" may be regions in an image that could belong to a particular object, such as a load of articles in the wash basket. A convolutional neural network is then used to compute features from the region proposals and the extracted features will then be used to determine a classification for each particular region.

According to still other embodiments, an image segmentation process may be used along with the R-CNN image recognition. In general, image segmentation creates a pixel-based mask for each object in an image and provides a more detailed or granular understanding of the various objects within a given image. In this regard, instead of processing an entire image—i.e., a large collection of pixels, many of which might not contain useful information-image segmentation may involve dividing an image into segments (e.g., into groups of pixels containing similar attributes) that may be analyzed independently or in parallel to obtain a more detailed representation of the object or objects in an image. This may be referred to herein as "mask R-CNN" and the like.

According to still other embodiments, the image recognition process may use any other suitable neural network process. For example, the image recognition process may include using Mask R-CNN instead of a regular R-CNN architecture. In this regard, Mask R-CNN is based on Fast R-CNN which is slightly different than R-CNN. In addition, a K-means algorithm may be used. Other image recognition processes are possible and within the scope of the present subject matter.

It should be appreciated that any other suitable image recognition process may be used while remaining within the scope of the present subject matter. For example, the image or images from the camera (e.g., the camera of a remote user interface device, as noted above) may be analyzed using a deep belief network ("DBN") image recognition process. A DBN image recognition process may generally include stacking many individual unsupervised networks that use each network's hidden layer as the input for the next layer. According to still other embodiments, the image or images may be analyzed by the implementation of a deep neural network ("DNN") image recognition process, which generally includes the use of a neural network (computing systems inspired by biological neural networks) with multiple layers between input and output. Other suitable image recognition processes, neural network processes, artificial intelligence ("AI") analysis techniques, and combinations of the above described or other known methods may be used while remaining within the scope of the present subject matter.

An overlay may be developed from such image analysis or processing, whereby the overlay may correspond to positions or alignments of components of the washing machine appliance, contents within the wash chamber, or other objects in and/or around the washing machine appliance. For example, the image analysis or processing may include recognizing, determining, and/or estimating the volume of the wash chamber from the image. As another example, the image analysis or processing may also or instead include recognizing, determining, and/or estimating the size and/or position of a load of articles in the wash chamber. In additional exemplary embodiments, one or more other components or aspects of the washing machine appliance may be recognized or otherwise analyzed from the obtained image as well as or instead of the wash chamber volume and/or load of articles.

Turning now to FIGS. 4 through 7 generally, FIGS. 4 through 7 illustrate exemplary images which may be provided on, e.g., displayed by, a display 1002 of the remote user interface device 1000. The display 1002 may generate, reproduce, and/or otherwise display a static image or a dynamic (e.g., animated or updated) image, which may be or include an image of a washing machine appliance, such as the exemplary washing machine appliance 100 or 10 described above, obtained by a camera of the remote user interface device. The image obtained by the camera may be, for example, a live image, e.g., that is captured and displayed in real time. In other embodiments, the image may be a still image or a series of still images, such as a chronological series of images, e.g., taken one or more seconds apart at generally regular intervals. For example, the image, e.g., live image or series of still images, may reflect addition or removal or rearrangement of articles within the wash chamber 124.

The image provided on the display 1002 of the remote user interface 1000 may be a composite or synthesized image, e.g., the image may include additional elements as well as the image obtained by the camera, such as a graphical overlay, a text overlay, or a combined overlay including both graphical elements and text elements. For example, such elements may include text elements 1010, where the text elements 1010 on the display 1002 may include explanatory text or instructions, e.g., pertaining to one or more operating parameters of the washing machine appliance, such as load size. Also by way of example, the overlay may user interface elements, e.g., interactive elements, such as a control or input 1012.

FIGS. 4 and 6 each represents an exemplary image, such as a live image, of the washing machine appliance which may be captured, e.g., by a camera of a remote user interface device, and which may be displayed, e.g., live or in real-time or near real-time, on a display such as the display 1002 of the remote user interface device 1000. Thus, it is to be understood that a "live image" as used herein is intended to include images which are continuously updated in real time or with some delay and which may be updated at least about once per second, e.g., which have a refresh rate of 1 Hz or greater. In particular, the exemplary images in FIGS. 4 and 6 each includes or depicts at least a portion of the washing machine appliance, such as the wash basket 124 (FIG. 2) and/or the opening 142 which permits access into the wash basket 124. In some embodiments, the image may also include or depict a load of articles 1004 in the wash basket 124.

Figure 5:
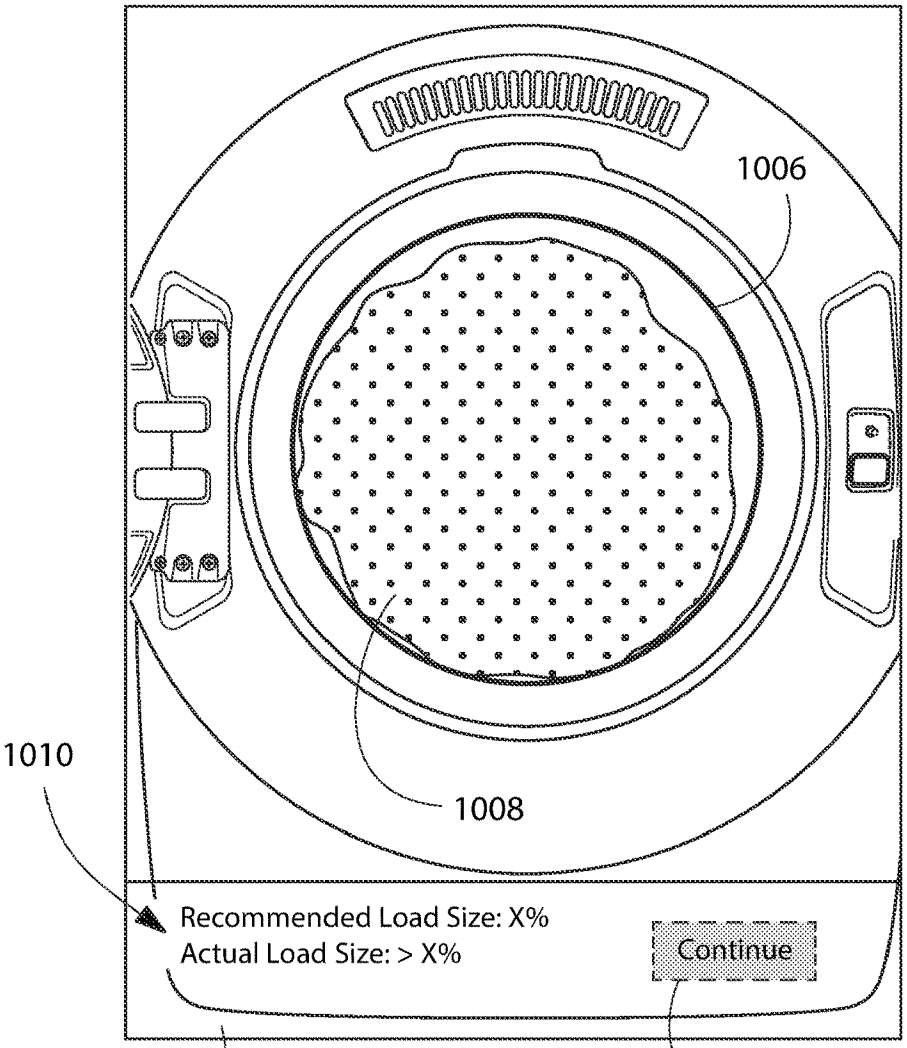
FIG. 5 illustrates an exemplary image which may be displayed on a display of a remote user interface device, where the image includes an image of a washing machine appliance and an overlay, according to one or more exemplary embodiments of the present subject matter.
Figure 7:
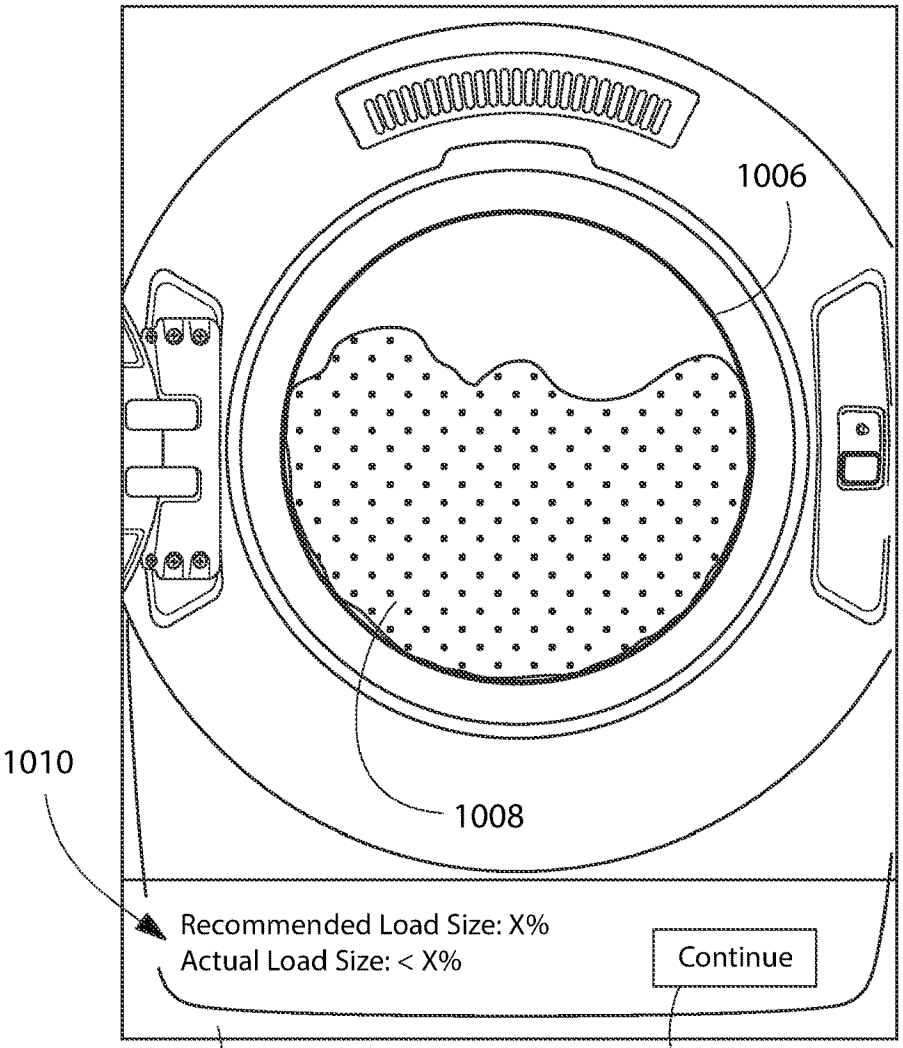
FIG. 7 illustrates an exemplary image which may be displayed on a display of a remote user interface device, where the image includes an image of a washing machine appliance and an overlay, according to one or more exemplary embodiments of the present subject matter.

An image such as one of the images illustrated in FIGS. 4 and 6 may be a live image and may be used to guide a user in obtaining a still image of the washing machine appliance and the load of articles 1004 therein. In some embodiments, the resultant still image may be analyzed, e.g., to determine a load size and/or compare the load size to a recommended load size. For example, such guidance may include a fiducial marker or target, such as a reticle 1006, which is configured to align (on-screen, e.g., in the image provided on the display 1002) with the washing machine appliance, such as with a portion thereof, such as with an opening into the wash basket, e.g., the opening 142. The reticle 1006 may be a circle, e.g., as illustrated in FIGS. 5 and 7, or other suitable shape generally corresponding to one or more components (or portions or segments thereof) of the washing machine appliance with which the reticle is configured to align. Thus, for example, exemplary methods according to the present disclosure may include displaying, on a display of the remote user interface device, a reticle configured to align with the washing machine appliance, such as with the wash basket 124 and/or opening 142 into the wash basket 124. In such embodiments, displaying the reticle may include overlaying the reticle on a live image of the washing machine appliance. Such embodiments may also include obtaining the image, e.g., still image, while the reticle is aligned with the wash basket in the live image on the display of the remote user interface device. Such alignment may serve to promote consistency and accuracy in image processing and image analysis performed on the resultant image, e.g., by ensuring that the image to be analyzed is captured at a known distance from the washing machine appliance and a known angle to the washing machine appliance, or within an acceptable tolerance, such as plus or minus ten percent or ten degrees, of the known distance and angle.

FIGS. 5 and 7 each represents an exemplary image including an overlay in addition to the image of the washing machine appliance, such as an image which may be displayed on the display 1002 of a remote user interface device. As illustrated in FIGS. 5 and 7, the overlay may include a mask 1008, e.g., which corresponds to or overlies (in the image on the display 1002) the load of articles 1004 (FIGS. 4 and 6) in the wash basket. Such mask 1008 may be used in or generated by an image analysis process which includes determining or identifying, such as via one or more region proposals, a region (e.g., within the wash chamber 124) occupied by the load of articles 1004. For example, the region occupied by the load of articles 1004 may be used in determining a load size of the load of articles. The load size may be, for example, measured or estimated as a proportion, such as a percentage, of the volume of the wash chamber 124. The proportion may be, for example, a ratio or percentage of the region occupied by the load of articles compared to a region representing the entire wash chamber. Such load size may be displayed as a text element of the overlay, e.g., such as "Actual Load Size" in text element 1010 in FIGS. 5 and 7.

The load of articles 1004 illustrated in FIGS. 4 and 5 is an example of a load which exceeds the recommended load size. For example, the recommended load size may be a maximum load size to permit tumbling and/or agitation of the articles within the wash basket during a wash cycle in the washing machine appliance. For example, the load sizes, both Recommended and Actual, e.g., as noted in text element 1010 in the exemplary embodiment illustrated in FIG. 5, may expressed as percentages, e.g., percentages of the volume of the wash chamber 124. For example, the Recommended Load Size may be X %, such as about ninety percent (90%) or less, such as about eighty percent (80%) or less, such as about seventy percent (70%) or less. In the exemplary embodiment illustrated in FIGS. 4 and 5, the Actual Load Size, e.g., as estimated or otherwise determined using image analysis or processing, e.g., mask R-CNN image analysis, is greater than the Recommended Load Size, e.g., the Actual Load Size is >X %, as indicated in text element 1010 in FIG. 5. In some embodiments, the washing machine appliance may be locked when the Actual Load Size is greater than the Recommended Load Size, such as when the Actual Load Size exceeds the Recommended Load Size by at least a factor of safety threshold. For example, the washing machine appliance may be locked by disabling one or more controls of the washing machine, such as disabling the input 1012 on the display 1002, for example, the input 1012 may be greyed out, e.g., as indicated in FIG. 5, or otherwise unavailable or unresponsive.

The load of articles 1004 illustrated in FIGS. 6 and 7 is an example of a load which is less than or equal to the recommended load size. As mentioned, the recommended load size may be a maximum load size for optimal treatment of the articles during a wash cycle of the washing machine appliance, such as a percentage of the volume of the wash chamber 124, e.g., about ninety percent (90%) or less, as described above. In the exemplary embodiment illustrated in FIGS. 6 and 7, the Actual Load Size, e.g., as estimated or otherwise determined using image analysis or processing, e.g., mask R-CNN image analysis, is less than (or equal to) the Recommended Load Size, e.g., <X %, as indicated in text element 1010 in FIG. 7. When the Actual Load Size is less than or equal to the Recommended Load Size, the washing machine appliance may be unlocked, e.g., may remain unlocked if not previously unlocked, or may be changed from a locked state to an unlocked state, and then the washing machine may be activated, e.g., to perform a wash cycle.

Figure 8:
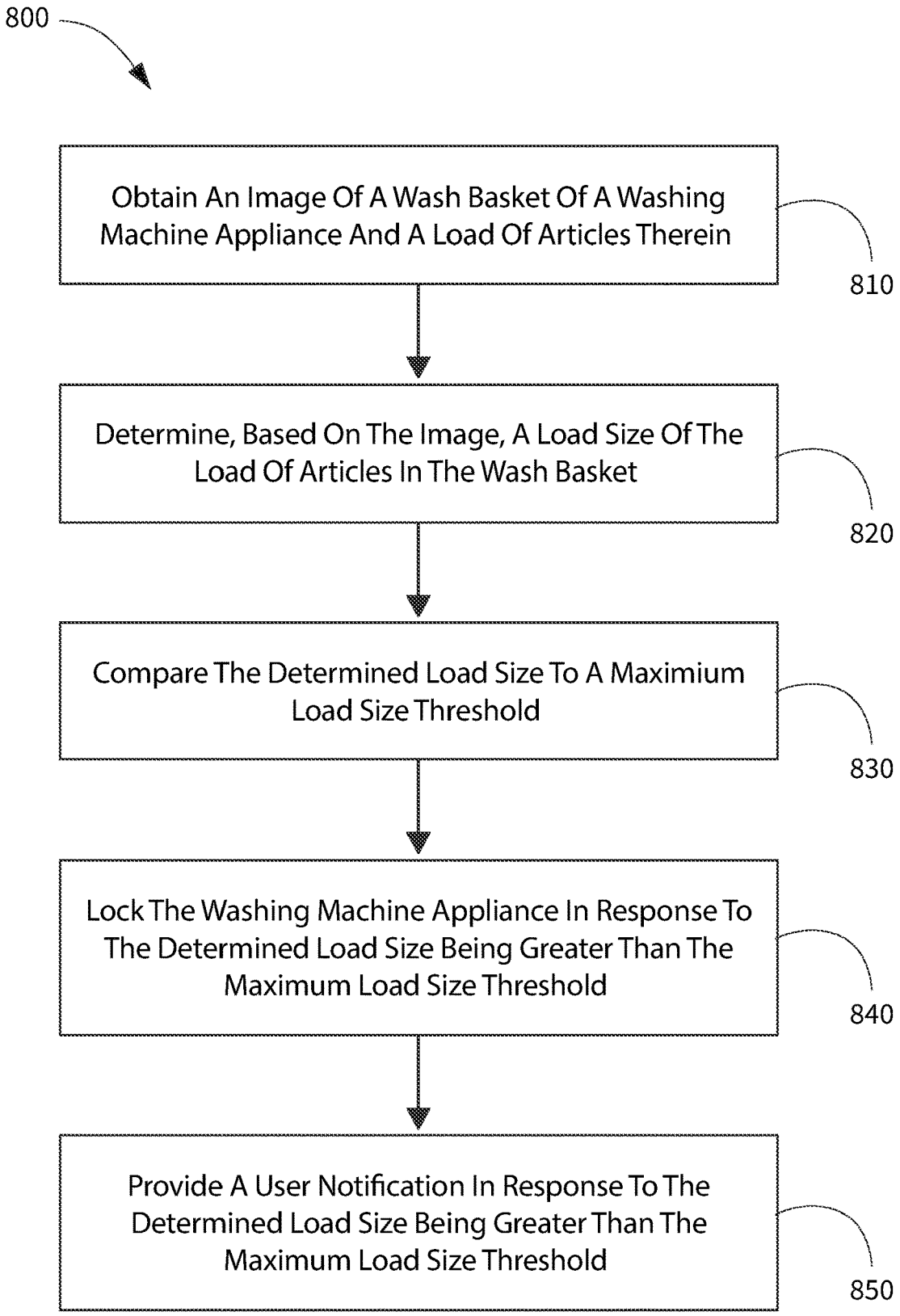
FIG. 8 provides a flow chart illustration of an exemplary method of operating a washing machine appliance according to one or more exemplary embodiments of the present subject matter.

As illustrated in FIG. 8, embodiments of the present disclosure also include methods of operating a washing machine appliance, such as the exemplary washing machine appliance 100 described above, as well as other possible exemplary washing machine appliances including top load washing machine appliances, washer-dryer combination appliances, etc. Exemplary methods according to the present subject matter include the method 800 illustrated in FIG. 8. Methods such as method 800 can be used to operate any suitable washing machine appliance. For example, such methods may be utilized to operate washing machine appliance 100 of FIGS. 1 and 2, or other washing machine appliances. Controller 186 of washing machine appliance 100 may be programmed to implement method 800, e.g., controller 186 is capable of and may be operable to perform any methods and associated method steps as disclosed herein. In some embodiments, the controller 186 may perform method steps in combination with one or more remote computing devices, such as a remote database or remote processor or one or more other remote computing devices, e.g., in a distributed computing environment such as the cloud, the fog, and/or the edge. Thus, references herein to a "remote computing device" include at least one such device with which a washing machine appliance and/or remote user interface device communicates, e.g., over the internet, such as one or more remote computing devices in the cloud, etc. In such embodiments, the controller 186 may communicate with such remote computing device or devices via the internet, among other possible communications means. For example, some embodiments of the methods disclosed herein may include distributed computing whereby certain steps or calculations/determinations are performed locally, e.g., by the controller 186 onboard the washing machine appliance 100, while other steps or calculations/determinations are performed by a remote computing device with which the controller 186 communicates, e.g., via the internet.

As illustrated in FIG. 8, the method 800 may include a step 810 of obtaining an image of a wash basket of the washing machine appliance and a load of articles therein. The image may be obtained, for example, by a remote user interface device, and such image capture may be guided, e.g., using a reticle displayed on the remote user interface device, as described above. For example, the remote user interface device may include a camera, such as the remote user interface device may be a smartphone or tablet computer including a camera, as is recognized by those of ordinary skill in the art. The image which is obtained may include the load of articles and surrounding portions of the wash chamber, e.g., such that the percentage or proportion of the wash chamber that is occupied by the load of articles may be discerned in the image, such as by image analysis or processing. Thus, exemplary embodiments of method 800 may include a step 820 of determining, based on the image, a load size of the load of articles in the wash basket. For example, the determined load size may be a percentage, such as a percentage of the wash basket internal volume that is occupied by the load of articles, e.g., which may be determined based on the size of a region in the image occupied by the load of articles.

In some embodiments, method 800 may further include a step 830 of comparing the determined load size to a maximum load size threshold. For example, comparing the determined load size to the maximum load size threshold may include determining whether the determined load size is greater than the maximum load size threshold or is less than or equal to the maximum load size threshold. In some embodiments, the maximum load size may be or correspond to a Recommended Load Size, e.g., that is communicated to a user, such as displayed on a remote user interface device, such as in a text element, e.g., text element 1010, in an overlay on an image of the washing machine appliance, e.g., as described above.

Method 800 may also include a step 840 of locking the washing machine appliance in response to the determined load size being greater than the maximum load size threshold. For example, locking the washing machine appliance may include locking a user interface of the washing machine appliance, such as remote and/or local controls of the washing machine appliance. For example, the user interface may be locked, e.g., disabled, in that user input devices may be deactivated or otherwise placed in a non-responsive state to prevent activation of the washing machine appliance. When the washing machine is locked, such as the user interface of the washing machine appliance is locked, user inputs, e.g., on the control panel 180 of the washing machine appliance 100 and/or on the display 1002 of the remote user interface device 1000 (e.g., where display 1002 comprises a touchscreen) are disabled whereby the washing machine appliance, such as mechanical components thereof (e.g., one or more pumps, and/or motors, etc.) will not be activated in response to inputs or manipulation (e.g., button pressing or tapping on the touchscreen) of the user input devices or user interface.

Method 800 may further include a step 850 of providing a user notification on the remote user interface device in response to the determined load size being greater than the maximum load size threshold. The user notification may include, for example, an indication that the load size is larger than recommended. In some embodiments, e.g., where the washing machine appliance is a commercial washing machine appliances, e.g., in a laundromat, dormitory, or apartment complex, the user notification may also or instead include a prompt to reserve an additional washing machine appliance in order to divide the load of articles into multiple smaller loads, such as the user notification may include a prompt to reserve an additional washing machine appliance in response to the determined load size being greater than the maximum load size threshold.

Figure 9:
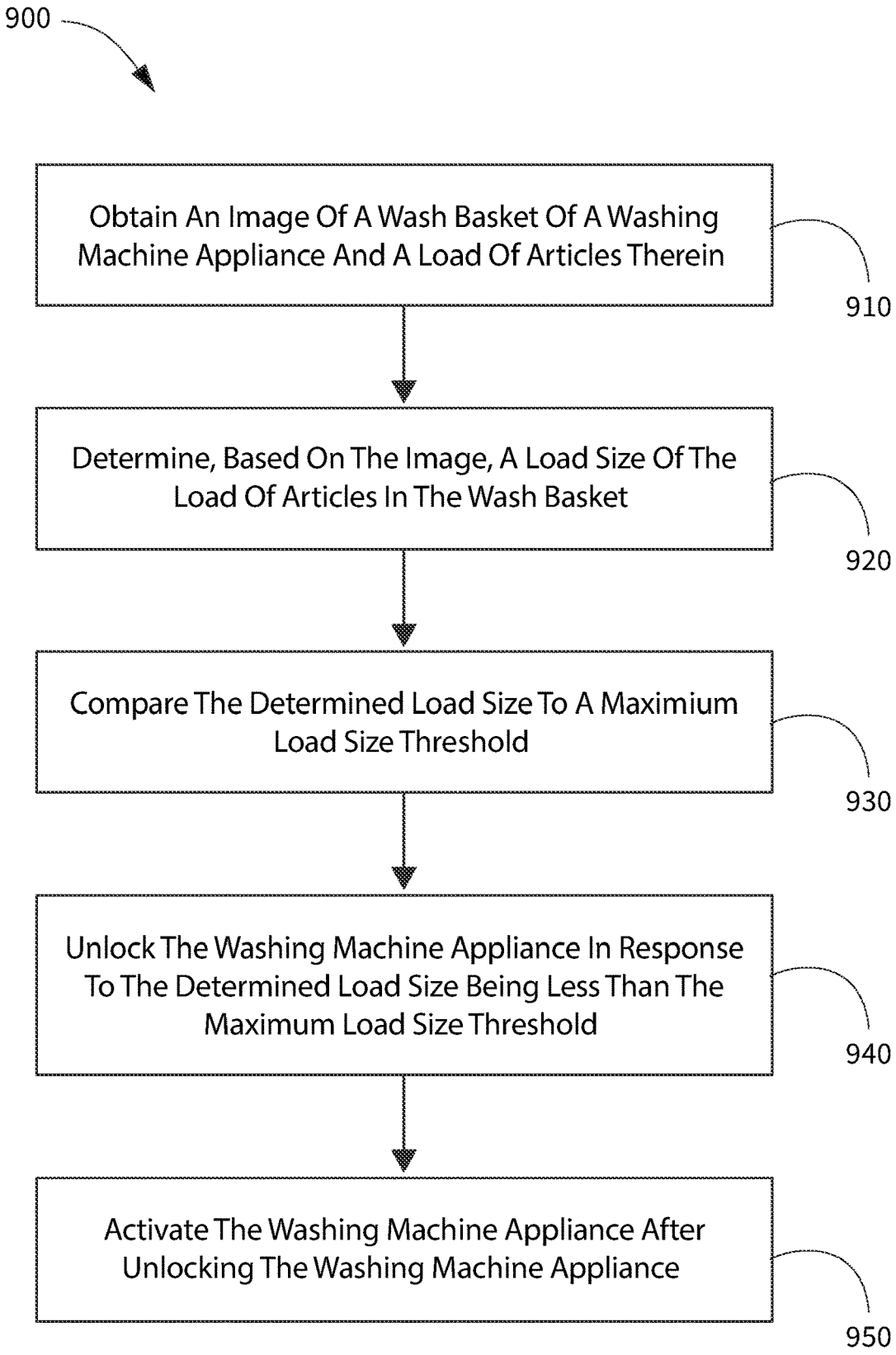
FIG. 9 provides a flow chart illustration of another exemplary method of operating a washing machine appliance according to one or more additional exemplary embodiments of the present subject matter.

Additional exemplary embodiments of the present disclosure also include methods of operating a washing machine appliance such as method 900 illustrated in FIG. 9. Such methods may include, for example, locking the washing machine appliance, such as disabling controls of the washing machine appliance as described above. In some embodiments, method 900 may also include a step 910 of obtaining an image of a wash basket of the washing machine appliance and a load of articles therein. The image may be obtained, for example, by a remote user interface device, and such image capture may be guided, e.g., using a reticle displayed on the remote user interface device, e.g., as described above.

Method 900 may further include a step 920 of determining, based on the image, a load size of the load of articles in the wash basket, e.g., using image analysis and/or image processing, such as any of the exemplary models, algorithms, etc., as described above.

In some embodiments, method 900 may further include a step 930 of comparing the determined load size to a maximum load size threshold. For example, comparing the determined load size to the maximum load size threshold may include determining whether the determined load size is greater than the maximum load size threshold or is less than or equal to the maximum load size threshold, etc., as described above.

Method 900 may also include a step 940 of unlocking the washing machine appliance in response to the determined load size being less than the maximum load size threshold, such as less than or equal to the maximum load size threshold. In some embodiments, unlocking the washing machine appliance may include unlocking one or more user interfaces of the washing machine appliance, such as a remote user interface, e.g., a smartphone app, and/or a local user interface such as control panel 180. For example, unlocking the user interface may include permitting the washing machine appliance, e.g., the controller 186 thereof, to activate one or more mechanical components of the washing machine appliance in response to a user input received at the user interface, e.g., at control panel 180.

Method 900 may further include a step 950 of activating the washing machine appliance after unlocking the washing machine appliance. For example, when the user interface of the washing machine appliance is unlocked, the washing machine appliance, e.g., one or more mechanical components thereof, may be activated, such as turning on or activating a motor or pump. For example, activating the washing machine appliance may include performing a cycle of the washing machine appliance, such as the exemplary operation described above, e.g., loading laundry items into wash basket 122 through opening 142, etc.

In some embodiments, exemplary methods of operating a washing machine appliance according to the present disclosure, such as method 800 or method 900, may include determining an identity of the washing machine appliance. In such embodiments, the maximum load size threshold may be based on the identity of the washing machine appliance. For example, the identity of the washing machine appliance may be determined by the remote user interface device based on an image of an identifying indicium of the washing machine appliance. For example, identifying indicium of the washing machine appliance may be encoded in a bar code, such as a QR code. As a further example, the identifying indicium may include a serial number of the washing machine appliance, e.g., which may be recognized in a captured image of the washing machine appliance by the remote user interface device. Thus, determining the identity of the washing machine appliance may include scanning a code on the washing machine appliance or taking a picture of the washing machine appliance, such as a picture of a nameplate on the washing machine appliance.

Determining the load size of the load of articles in the wash basket based on the image in exemplary methods of operating a washing machine appliance according to the present disclosure, such as method 800 or method 900, may include determining a portion of the wash basket that is occupied by the load of articles. For example, determining the portion of the wash basket that is occupied by the load of articles may include applying a mask to a region occupied by the load of articles in the image of the wash basket of the washing machine appliance and the load of articles therein obtained by the remote user interface device and comparing the mask to an area of the wash basket. As one example of such image analysis, the region occupied by the load of articles in the image of the wash basket may be determined using a mask R-CNN model.

The several embodiments of the present disclosure provide numerous advantages. For example, but without limitation, the exemplary methods of operating a washing machine appliance may promote a more efficient and effective operation of the washing machine appliance, such as by ensuring a proper load size, e.g., the maximum amount of articles that can be effectively treated in each load. As another example, the exemplary methods may provide an improved user interface for operating a washing machine appliance, such as a more informative user interface which provides additional information about the washing machine appliance, operating cycles thereof, and/or a load of articles therein. Such improved user interfaces may also include interactive features, may be provided on a remote user interface device such as a smartphone or tablet computer, and may further include features for operating the washing machine appliance, such as controlling or initiating an operating cycle from the user interface, as well as features for identifying, selecting, and/or reserving an additional washing machine appliance in response to information, e.g., load size, about the load of articles in the washing machine appliance. Accordingly, a method of operating a washing machine appliance using a user interface, e.g., on a remote user interface device, according to the present disclosure, such as determining a load size using image analysis as described above, provides an improved user interface.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance, the method comprising:

obtaining, by a remote user interface device, an image of a wash basket of the washing machine appliance and a load of articles therein;

determining, based on the image, a load size of the load of articles in the wash basket;

comparing the determined load size to a maximum load size threshold; and providing a user notification on the remote user interface device in response to the determined load size being greater than the maximum load size threshold.

2. The method of claim 1, further comprising determining an identity of the washing machine appliance, wherein the maximum load size threshold is based on the identity of the washing machine appliance.

3. The method of claim 2, wherein the identity of the washing machine appliance is determined by the remote user interface device based on an image of an identifying indicium of the washing machine appliance.

4. The method of claim 1, further comprising displaying, on a display of the remote user interface device, a reticle configured to align with the washing machine appliance.

5. The method of claim 4, wherein displaying the reticle comprises overlaying the reticle on a live image of the washing machine appliance, wherein the image is obtained while the reticle is aligned with the wash basket in the live image on the display of the remote user interface device.

6. The method of claim 4, wherein the reticle is configured to align with an opening into the wash basket.

7. The method of claim 1, wherein the user notification comprises a prompt to reserve an additional washing machine appliance in response to the determined load size being greater than the maximum load size threshold.

8. The method of claim 1, wherein determining the load size of the load of articles in the wash basket based on the image comprises determining a portion of the wash basket that is occupied by the load of articles.

9. The method of claim 8, wherein determining the portion of the wash basket that is occupied by the load of articles comprises applying a mask to a region occupied by the load of articles in the image of the wash basket of the washing machine appliance and the load of articles therein obtained by the remote user interface device and comparing the mask to an area of the wash basket.

10. The method of claim 1, further comprising locking the washing machine appliance in response to the determined load size being greater than the maximum load size threshold.

11. A method of operating a washing machine appliance, the method comprising:

locking the washing machine appliance;

obtaining, by a remote user interface device, an image of a wash basket of the washing machine appliance and a load of articles therein;

determining, based on the image, a load size of the load of articles in the wash basket;

comparing the determined load size to a maximum load size threshold;

unlocking the washing machine appliance in response to the determined load size being less than the maximum load size threshold; and activating the washing machine appliance after unlocking the washing machine appliance.

12. The method of claim 11, further comprising determining an identity of the washing machine appliance, wherein the maximum load size threshold is based on the identity of the washing machine appliance.

13. The method of claim 12, wherein the identity of the washing machine appliance is determined by the remote user interface device based on an image of an identifying indicium of the washing machine appliance.

14. The method of claim 11, further comprising displaying, on a display of the remote user interface device, a reticle configured to align with the washing machine appliance.

15. The method of claim 14, wherein displaying the reticle comprises overlaying the reticle on a live image of the washing machine appliance, wherein the image is obtained while the reticle is aligned with the wash basket in the live image on the display of the remote user interface device.

16. The method of claim 14, wherein the reticle is configured to align with an opening into the wash basket.

17. The method of claim 11, wherein determining the load size of the load of articles in the wash basket based on the image comprises determining a portion of the wash basket that is occupied by the load of articles.

18. The method of claim 17, wherein determining the portion of the wash basket that is occupied by the load of articles comprises applying a mask to a region occupied by the load of articles in the image of the wash basket of the washing machine appliance and the load of articles therein obtained by the remote user interface device and comparing the mask to an area of the wash basket.

* * * * *